US005617619A

United States Patent [19]

Knudson

[11] Patent Number: 5,617,619

[45] Date of Patent: Apr. 8, 1997

[54] RIVET FASTENING APPARATUS AND METHOD

[76] Inventor: Gary A. Knudson, 30401 Heavenly Ct., Evergreen, Colo. 80439

[21] Appl. No.: 289,272

[22] Filed: Aug. 11, 1994

[51] Int. Cl.[6] ..... B23P 19/00

[52] U.S. Cl. ..... 29/21.1; 29/243.5; 30/366; 72/325

[58] Field of Search ..... 29/21.1, 243.5; 30/363, 366; 72/325

[56] References Cited

U.S. PATENT DOCUMENTS

| | | | |
|---|---|---|---|
| 216,912 | 6/1879 | Torrans | 29/21.1 |
| 1,176,793 | 3/1916 | Tuttle . | |
| 2,333,966 | 11/1943 | Weiss | 29/21.1 X |
| 3,261,073 | 7/1966 | Klenk . | |
| 3,505,714 | 4/1970 | Boileau | 29/21.1 |
| 4,306,511 | 12/1981 | Ashby et al. . | |
| 4,391,037 | 7/1983 | Giasini | 29/21.1 X |
| 5,231,748 | 8/1993 | Knudson et al. . | |

FOREIGN PATENT DOCUMENTS

| | | | |
|---|---|---|---|
| 0096328 | 5/1985 | Japan | 72/325 |
| 0639295 | 11/1983 | Sweden | 72/325 |

*Primary Examiner*—Joseph M. Gorski
*Attorney, Agent, or Firm*—Ancel W. Lewis, Jr.

[57] ABSTRACT

A rivet fastening apparatus and method for joining two pieces by forming a rivet from the material of the pieces. First and second dies are used and the second die is moved into the first die to form a punched out hole and circumferentially spaced tabs in the pieces. The position of the dies are reversed relative to the pieces and the second die is advanced into the first die a second time so that a portion of the second die gives a radially outward direction to the tabs and another portion of the second die flattens the tabs against one another and against an outer face of one of the pieces to form a rivet head. One second die is shaped to form a round hole and four tabs and another second die forms a triangular hole with three tabs. Another embodiment has a punch rod in the first die that forms a smaller hole that is enlarged by a second die with a center through hole that receives the punch rod.

15 Claims, 5 Drawing Sheets

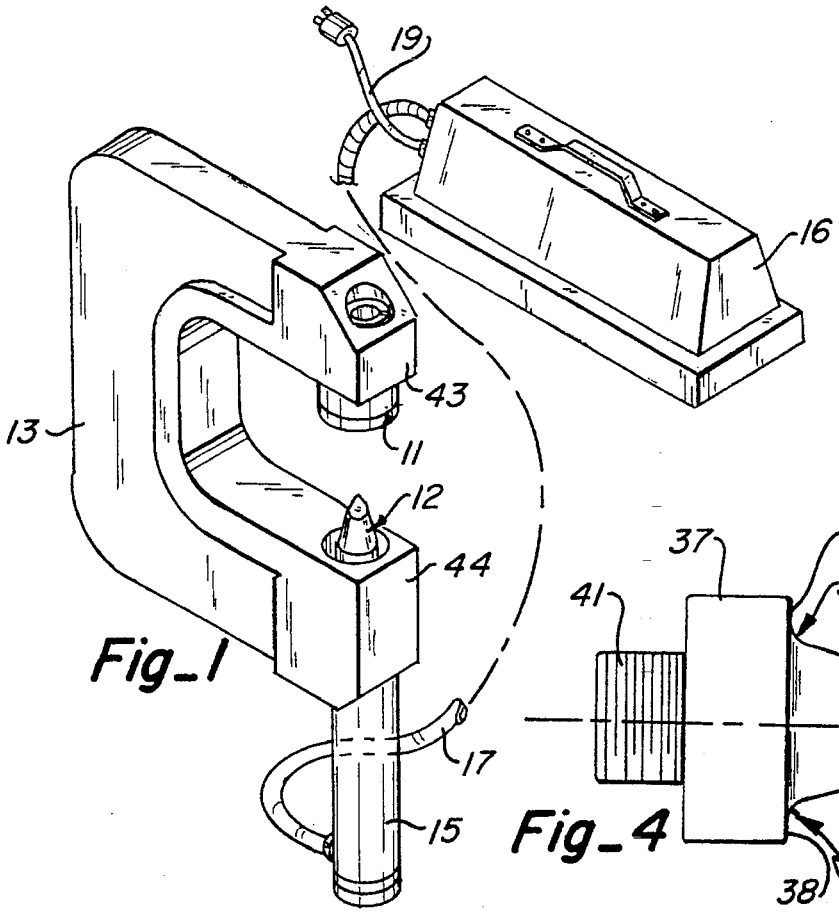
Fig_1
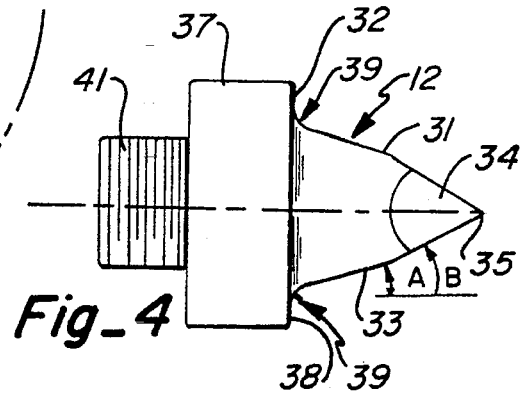
Fig_4
Fig_2
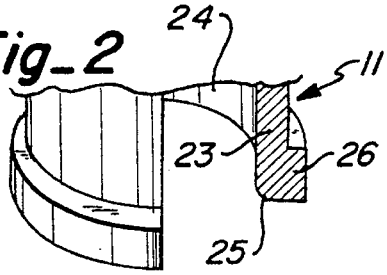
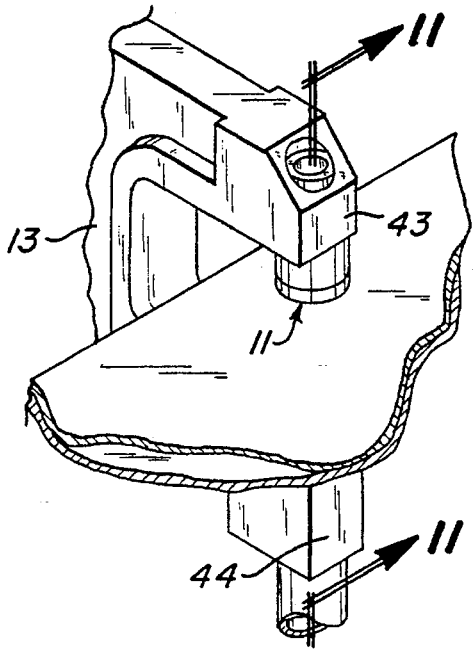
Fig_5
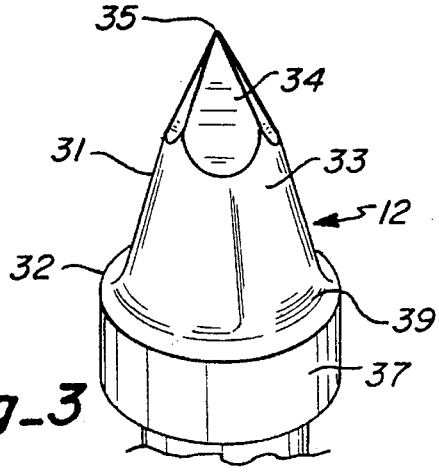
Fig_3

Fig_17
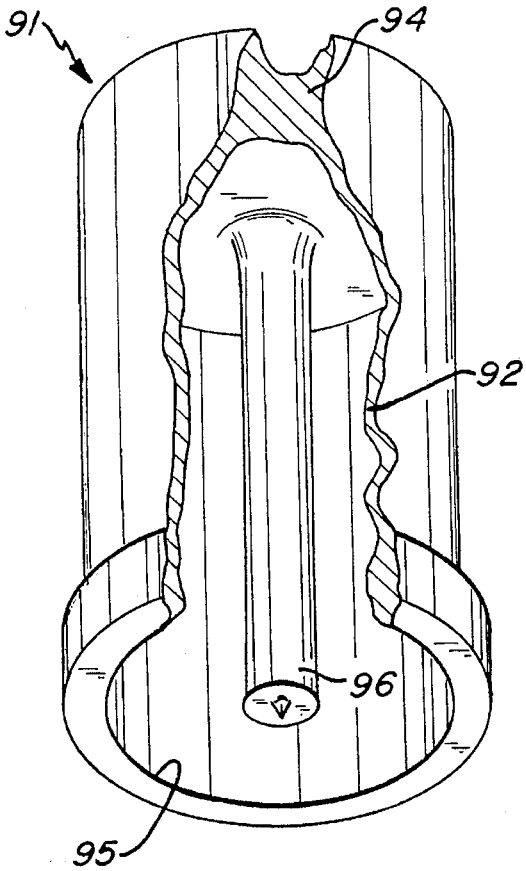
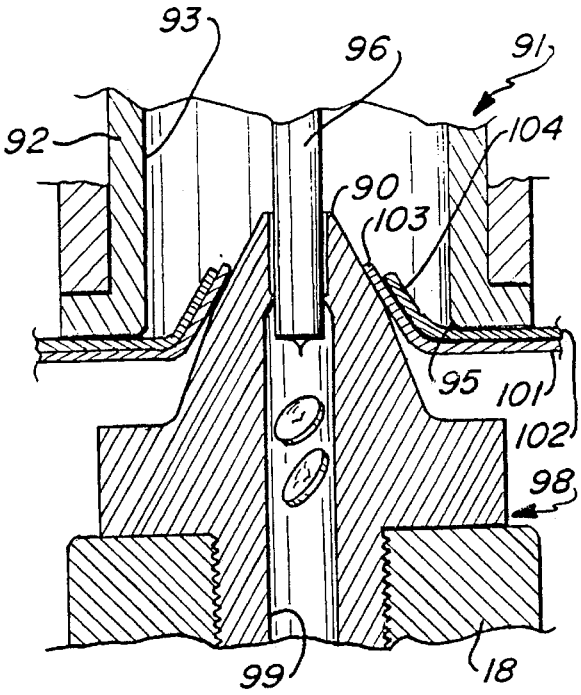
Fig_19
Fig_20
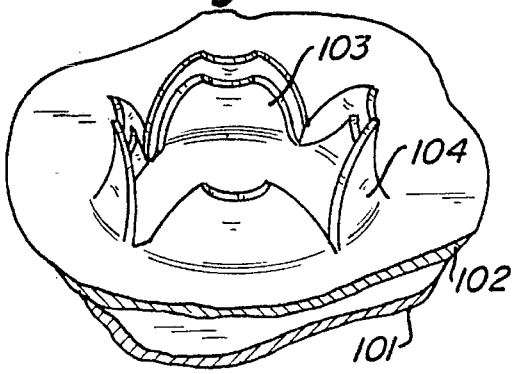
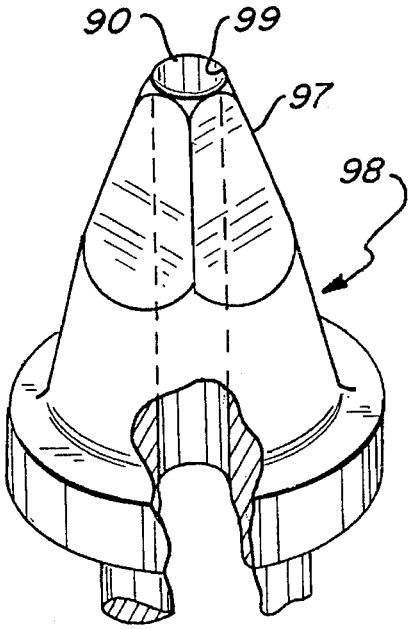
Fig_18
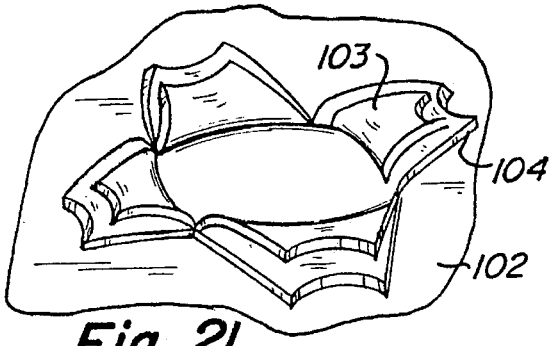
Fig_21

RIVET FASTENING APPARATUS AND METHOD

TECHNICAL FIELD

This invention relates to a rivet fastening apparatus and a method for joining two pieces and more particularly to a portable apparatus and a method for forming relatively large diameter holes and a rivet from punched out tabs in two superposed, relatively heavy gauge sheet metal pieces in a building.

BACKGROUND ART

The fastening together of pieces, such as two pieces of relatively heavy sheet metal in a building has heretofore been accomplished primarily by the drilling of holes and the using of conventional bolt and nut fasteners, by the use of self-drilling and self-tapping screws, and by using conventional rivets that are separate from the sheet metal. In Knudson U.S. Pat. No. 5,231,748 there is disclosed fastening apparatus for joining two sheet metal pieces using a separate rivet that is positioned in holes in the pieces and has opposed rivet flanges that are flattened against opposed outer faces of the pieces.

A number of attempts have been made to use hand tools to punch and crimp relatively small holes in relatively light gauge metals. Tuttle U.S. Pat. No. 1,176,793 discloses a hand tool comprising a pointed punch and a female die member with a round hole by which aligned holes are formed in the two pieces of relatively thin sheet metal together with punched out continuous or circular projecting portions and then the punch and female dies are reversed and the punched out continuous or circular projecting portions are folded back to form a rivet head to fasten the two pieces together.

Klenk U.S. Pat. No. 3,261,073 discloses a hand operated tool which describes only the operation of perforating at least two layers of relatively thin sheet material as a part of a punching operation. The punch member has at least two circumferentially arranged flat angled faces tapered to a point to cut the material into separate projecting flaps or tabs. The clinching operation is not described.

Ashby U.S. Pat. No. 4,306,511 discloses a pierce and extrusion punch and cooperating die that forms a continuous rivet head in the form of two coaxial flattened tubes.

DISCLOSURE OF THE INVENTION

Punch and crimp rivet fastening apparatus and a fastening method for relatively heavy gauge sheet metal and suitable for forming relatively large holes are disclosed. The apparatus includes opposed first and second die members with the second die member moved relative to the first die member to punch a hole and form punched out circumferentially spaced projecting tabs in two superposed pieces of sheet metal. The dies are reversed relative to the pieces and the second die is moved to first direct the tabs radially outwardly and then transversely to a flattened condition against one another and against an adjacent outer face of one of the pieces to form a rivet head to fasten the two pieces together. One second die forms a round hole and four tabs. Another second die forms a triangular hole and three tabs. Another embodiment has a punch on the first die that forms a smaller hole that is enlarged by the associated second die provided with a through hole that receives the punch.

BRIEF DESCRIPTION OF THE DRAWINGS

Details of this invention are described in connection with the accompanying drawings which like parts bear similar reference numerals in which:

FIG. 1 is a perspective view of a portable punch and crimp rivet fastening apparatus embodying features of the present invention.

FIG. 2 is a fragmentary perspective view of the first die shown in FIG. 1.

FIG. 3 is a fragmentary perspective view of a second die shown in FIG. 1.

FIG. 4 is a side elevation view of the second die shown in FIG. 1.

FIG. 5 is a perspective view of the fastening apparatus shown in FIG. 1 with two pieces of sheet material in place between the dies for performing the punching operation.

FIG. 17 is a perspective view of another form of a first die with outer wall portions broken away to show inner construction.

FIG. 18 is a perspective view of another form of second die used with the first die of FIG. 17 with outer wall portions broken away to show inner construction.

FIG. 19 is a vertical cross-section view showing the dies of FIGS. 17 and 18 making a hole and tabs in two pieces.

FIG. 20 is a perspective view of two pieces of sheet material after the second die of FIG. 18 has penetrated the pieces to form a hole through and tabs in the pieces.

FIG. 21 is a perspective view showing the final position of the tabs shown in FIG. 20 to form the rivet.

DETAILED DESCRIPTION

Figure 6:
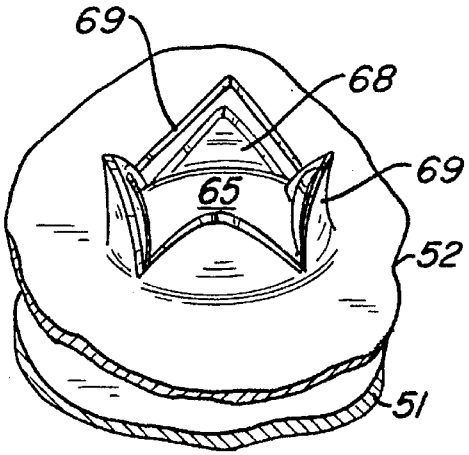
FIG. 6 is a perspective view of two pieces of sheet material after the second die has penetrated the pieces to form a hole through and tabs in the pieces.
Figure 7:
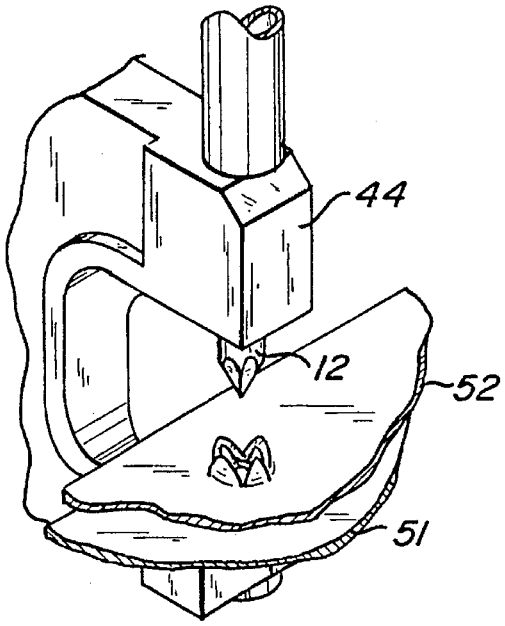
FIG. 7 is a perspective view of the fastening apparatus showing the sheet material shown in FIG. 6 and the dies in a reversed position relative to the pieces and the second die in a retracted position.
Figure 9:
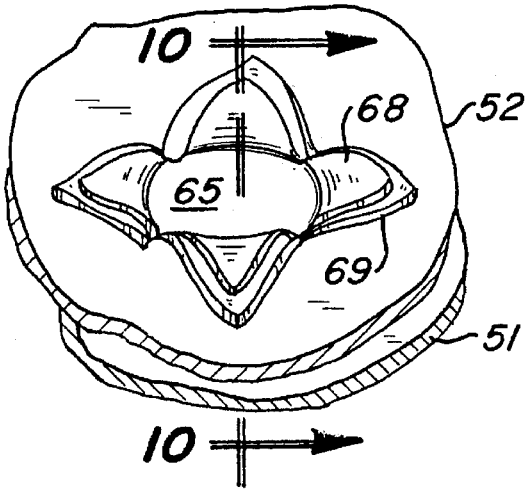
FIG. 9 is a perspective view showing the final position for the tabs in a flattened condition to form the rivet.
Figure 8:
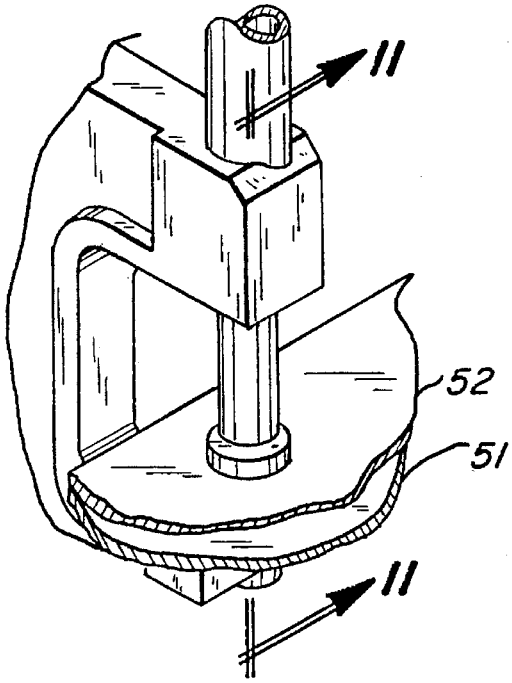
FIG. 8 is a perspective view of the fastening apparatus with the second die in an extended position to flatten the tabs and form the rivet.

Referring now to FIG. 1 there is shown a first die 11 and a second die 12 spaced from, opposite, and in coaxial alignment with the first die with the dies being supported on a portable C-shaped frame 13. The second die 12 is moved toward and away from the first die between retracted and extended positions and to the extended position by a two-way hydraulic cylinder 15 that is powered by a portable hydraulic pressure source 16 via flow line 17. The cylinder 15 has an actuating rod 18 that moves between the extended and retracted positions. The hydraulic power source, in turn, is connected to a suitable electric power source (not shown) by a plug-in cord 19.

The first die 11 is a female punch die in the form of a tubular body 23 having a circular cross-section and having a circular throughbore 24, a rounded or radiused internal rim 25 at one end and a flange or outwardly projecting external rim 26 extending radially outwardly from the internal rim 25.

The second die 12 is a male punch die that will slide into and acts in conjunction with the first die 11. The second die 12 has a front punch portion 31 and a rear crimp portion 32. The front punch portion 31 is of a conical shape with a circular cross section having a first external surface 33 tapering forwardly and radially inwardly at an angle to the longitudinal axis of the die with the angle being designated A. The tapered front portion 32 and specifically external surfaces 33 enable the second die to retract freely from the pieces after forming the holes therein. The front punch portion 31 further has a flat-sided front section having four circumferentially spaced external flat surfaces 34 each of a corresponding size and shape tapering forwardly and radially inwardly at an angle to the longitudinal axis with the angle designated B that is greater than angle A and the surfaces 34 terminate in a point 35. The embodiment shown has angle A equal to about 15 degrees and angle B equal to about 30 degrees.

The rear crimp portion 32 has an enlarged rear flange 37 providing a radially extending, forwardly facing second external surface 38 and is provided with a radially outwardly extending rounded filling section filling the angle between the first and second external surfaces 33 and 38 providing a curved third external surface 39 formed along a selected radius and merging with the first external surface 33 with these three external surfaces progressively acting on the tabs to flatten the tabs against one another and an outer face of one of the pieces as is described hereinafter. An externally threaded rear end section 41 enables the second die to be attached to the support by threading into an internally threaded hole in the end of the actuating rod 18.

Figure 11:
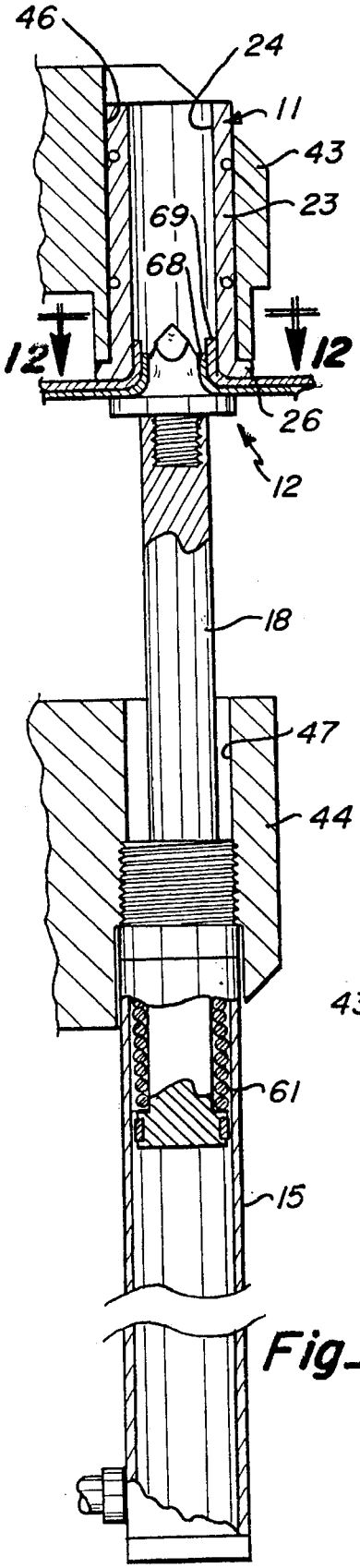
FIG. 11 is a sectional view taken along lines 11—11 of FIG. 5 and corresponds to FIG. 6.
Figure 13:
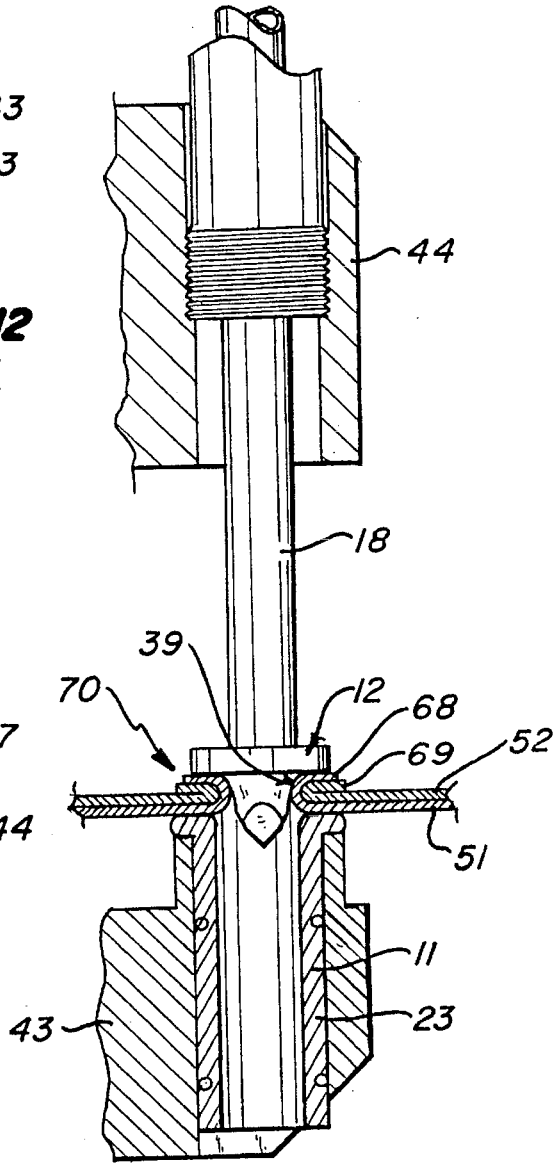
FIG. 13 is a sectional view taken along line 13—13 of FIG. 8 showing the second die in an extended position and the finished rivet and corresponds to FIGS. 8, 9 and 10.
Figure 12:
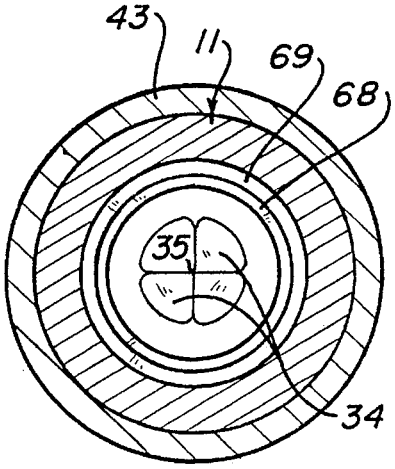
FIG. 12 is a sectional view taken along line 12—12 of FIG. 11.

The frame 13 shown has a first arm 43 opposite and spaced from a second arm 44 with the arms arranged parallel to one another and connected by an intermediate body portion 45. As seen in FIG. 11 the first die 11 is mounted in a bore 46 in the first arm 43 and the second die 12 is supported in a bore 47 in the second arm 44 and is firmly held in place by a threaded connection between cylinder 15 and bore 47.

In use there are shown two superposed first and second pieces 51 and 52 of sheet metal such as those typically found in a building to be connected together positioned between the dies. The sheet metal typically is a relatively heavy gauge metal such as about 16 to 24 gauge and particularly 20 gauge (0.32 inches). The actuating rod 18 is actuated to move the second die 12 upwardly and press the pieces 51 and 52 against the first die 11 and further extension of the second die 12 causes the front punch portion 31 to penetrate the two pieces forming a round hole 65 extending through both pieces and a first set of four circumferentially spaced projecting tabs 68 each of a substantially corresponding size and shape in the first piece 51 and a second set of four projecting tabs 69 of a substantially corresponding size and shape in the second piece 52. The tabs project out and away from a back face of the associated piece. The second die 12 is then retracted. The hole 65 is relatively large as compared to typical bolt holes and may range from about 0.5 inches to about 2.0 inches in diameter. A spring 61 in the cylinder 15 automatically returns the second die 12 to the retracted position when the pressure is released.

Figure 10:
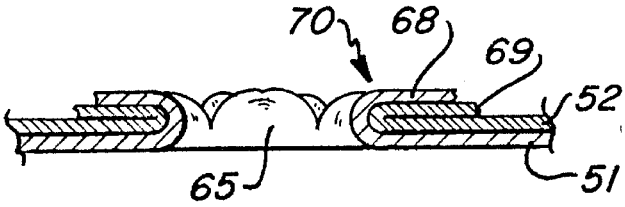
FIG. 10 is a sectional view taken along line 10—10 of FIG. 9 showing the rivet.

The two dies 11 and 12 are reversed in position relative to the pieces 51 and 52 by sliding the frame away from the pieces, turning the tool frame 13 over and repositioning the dies in line with the hole. The actuating cylinder rod 18 is extended and second die 12 is again extended. This time the curved third external surface 39 and second external surface 38 presses against both sets of tabs 68 and 69 to push them down to curve the fold with surface 39 and press the tabs with surface 38 to a substantially flattened position as seen in FIG. 10 to form a rivet head 70 that is of the material of pieces 51 and 52 that holds the pieces together.

More particularly the first external surface 33 directs the tabs radially out at a slight taper angle relative to the longitudinal axis of the die and the curved third external surface 39 directs the tabs radially outwardly at an acute taper angle and the second external surface 38 directs the tabs at a transverse of 90 degree angle to the longitudinal axis of the die. In this way each tab 69 of the second piece 52 is folded back on itself and flattened against the back face of sheet 52 and each tab 68 of the first sheet 51 is folded back and flattened against an adjacent tab 69 of the second piece. The inside diameter of the hole 65 is formed by the curved back fold in the first piece 51. The taper of surface 33 and curve of surface 39 work together to give direction to the rivet efficiency and a good clean rivet, i.e. a clean and efficient separation of the tabs.

Figure 14:
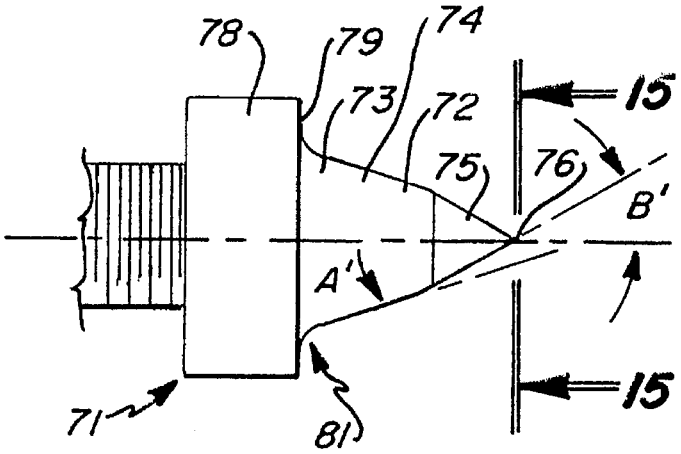
FIG. 14 is a side elevation view of another form of second die for forming a triangular-shaped hole and a three-tab rivet.
Figure 15:
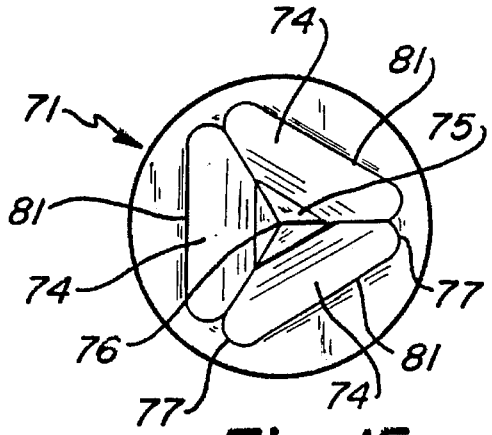
FIG. 15 is a front end view of the second die shown in FIG. 14.
Figure 16:
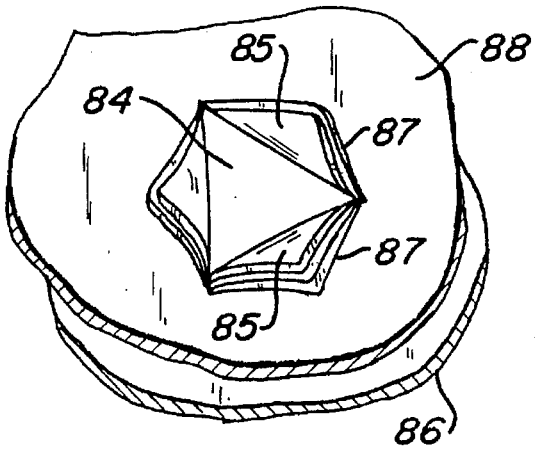
FIG. 16 is a perspective view of the hole through and rivet formed in two pieces by the second die of FIGS. 14 and 15.

Referring now to FIGS. 14–16 there is shown another form of second die 71. The first die (not shown) used with second die 71 is similar to first die 12 above discussed. The second die 71, in general, has a front punch portion 72 and a rear crimp portion 73. The front punch portion 72 is of a triangular shape with a triangular cross section having three circumferentially spaced, flat, first external surfaces 74 of a corresponding size and shape tapering forwardly and radially inwardly at an angle to the longitudinal axis of the die with the angle designated A'. Each flat first external surface 74 has a pair of opposed rounded or radiused corners 77 at the rear end. The front punch portion 72 has a front flat-sided section having three circumferentially spaced external flat surfaces 75 tapering forwardly and radially inwardly at an angle to the longitudinal axis with this angle designated B' and these surfaces 75 terminate in a front point 76. Angle A' is about 15 or about 17.5 degrees and angle B' about 35 or about 40 degrees.

The rear crimp portion 73 has an enlarged rear flange 78 providing a radially extending forwardly facing second external surface 79 and is provided with a radially outwardly extending rounded filling section filling the angle between the first and second external surfaces 74 and 79 providing a curved third external surface 81 formed along a selected radius that will give direction to the tabs and flare the tabs radially outwardly like surfaces 39 above described. There is also provided an externally threaded rear end section 82. In use the first and second dies above described using second die 71 as shown in FIG. 16 form a triangular shaped or three sided hole 84 and a first set of three circumferentially spaced projecting tabs 85 in a first piece 86 and a second set of three circumferentially spaced tabs 87 in a second piece 88. These tabs are folded back and radially out and flattened by reversing the tool relative to the pieces and again advancing the second die 71.

Referring now to FIGS. 17–21 there is shown another form of first die 91 that is a sleeve or tubular body 92 with throughbore 93 similar to body 23 previously described but further having an end cap 94 opposite a rounded internal rim 95 at one end. End cap 94 supports a central punch rod 96 that terminates at the internal rim 95.

The associated second die 98 is similar to second die 12 above described but further has a central through hole 99. The front end 90 of the four tapered faces 97 is truncated or flat rather than coming to a sharp point. Second die 98 is arranged so that when it is advanced into the first die 91 the punch rod 96 first forms a small hole in the first and second pieces 101 and 102 followed by having the second die 98 enlarge the hole to form a first set of circumferentially spaced tabs 103 in the first piece 101 and a second set of circumferentially spaced tabs 104 in the second piece 102. A reversal in the position of the first and second dies and advancing of the second die flares the tabs and finally flattens the tabs against one another and against an outer face of piece 102.

The present invention has application in metal framing including the fastening of studs to a track, trusses to one another and other applications where self-tapping screws, bolts and rivets have heretofore been employed.

The use of multi-sided faces on the male die which in turn forms a plurality of spaced tabs rather than a circumferentially continuous flange requires less power or force. The punching of the smaller hole followed by a larger hole shown in FIGS. 17–21 provides a cleaner rivet head i.e. one with fewer sharp edges.

Although the present invention has been described with a certain degree of particularity, it is understood that the present disclosure has been made by way of example and that changes in details of structure may be made without departing from the spirit thereof.

What is claimed is:

1. Punch and crimp rivet fastening apparatus particularly suitable for metal pieces of about 16 to 24 gauge sheet metal comprising:

a hollow first die, a second die opposite said first die, said second die having a generally radially extending circumferential rear crimp portion, a concavely rounded circumferential portion extending upwardly and inwardly from said rear crimp portion, a straight tapered circumferential rear section extending upwardly and inwardly from said rounded portion and a straight tapered circumferential front section extending upwardly and inwardly from said tapered rear section and terminating in an end, wherein the taper of said front section is substantially greater than the taper of said rear section, with said taper of said rear section being relatively small, and actuating means for moving said second die into said first die, said front and rear tapered sections forming a punched hole in superposed first and second pieces positioned between said dies and forming a first set of circumferentially spaced projecting tabs in said first piece that project away from a back face of said first piece and a second set of upstanding second projecting tabs in said second piece projecting out from a back face of said second piece when said second die is moved into said first die, and said front and rear tapered sections directing said tabs radially outwardly at a slight taper angle, said rounded portion directing said tabs radially outwardly at an acute taper angle, and said rear crimp portion directing said tabs at a transverse angle to a substantially flattened position against one another and against a back face of said first piece to form a rivet head to secure said pieces together when the relative positions of said pieces and dies are reversed and said second die is moved into said first die.

2. Apparatus as set forth in claim 1 wherein said first die is a tubular body of circular cross-section with a throughbore and having an internal rim at one end against which said pieces are forced by said second die and an external flange at said end.

3. Apparatus as set forth in claim 2 wherein said internal rim is rounded convexly along a preselected radius.

4. Apparatus as set forth in claim 1 wherein said front section has four spaced flat surfaces and said rear crimp portion forms a generally round hole in said pieces and four circumferentially spaced tabs in each of said pieces.

5. Apparatus as set forth in claim 1 wherein said front section has three flat surfaces and said rear crimp portion is generally triangular to form a generally triangular hole and three circumferentially spaced tabs in each of said pieces.

6. Apparatus as set forth in claim 5 wherein said flat surfaces and said tabs formed in each of said pieces are of a substantially equal dimension and are substantially equally spaced.

7. Apparatus as set forth in claim 1 wherein said first die a tubular body with an end cap at one end and a central punch rod supported by said end cap and said second die has a central through hole sized to receive said punch rod whereby said punch rod moves into said hole to form a smaller hole in said pieces and said second die enlarges said smaller hole to a larger hole in said pieces and forms said tabs in each of said pieces.

8. Apparatus as set forth in claim 1 including a portable support frame for supporting said dies, said support frame being generally C-shaped having a first arm spaced from and opposite a second arm with said arms being connected by an intermediate body portion.

9. Apparatus as set forth in claim 1 wherein said actuating means includes a two-way cylinder having a housing and an actuating rod.

10. Apparatus as set forth in claim 9 wherein said cylinder has means for automatically returning said actuating rod to a retracted position when the pressure is removed.

11. Apparatus as set forth in claim 1 wherein said rear section has a maximum diameter in the range of about 0.5 inches to about 2.0 inches.

12. Apparatus as set forth in claim 1 wherein the magnitude of the taper of said front section relative to said second section is about two to one.

13. Apparatus as set forth in claim 1 wherein the taper of said rear section is about 15 degrees from a longitudinal line along an outer periphery parallel to the longitudinal axis of said body.

14. Apparatus as set forth in claim 1 wherein the taper of said front section is about 30 degrees from a longitudinal line along an outer periphery parallel to the longitudinal axis of said body.

15. Portable punch and crimp fastening apparatus particularly suitable for metal pieces of about 16 to 24 gauge sheet metal comprising:

a generally C-shaped support frame having a first arm spaced from and opposite a second arm with said first and second arms being connected by an intermediate body portion, a hollow first die mounted in said first arm, said first die having a female tubular body of circular cross-section with a throughbore, a rounded internal rim at one end and a flange extending radially out from said rim, a second die mounted on said second arm portion opposite and in coaxial alignment with the first die, said second die having a generally radially extending circumferential rear crimp portion, a concavely rounded circumferential portion extending upwardly and inwardly from said rear crimp portion, a straight tapered circumferential rear section extending upwardly and inwardly from said rounded portion, and a straight tapered circumferential front section extending upwardly and inwardly from said tapered rear section and terminating in an end, wherein the taper of said front section is substantially greater than the taper of said rear section, with said taper of said rear section being relatively small, said second die being mounted for movement between a retracted position and an extended position, said front and rear tapered sections forming a punched hole in first and second superposed pieces positioned between said dies and a first set of circumferentially spaced punched out projecting tabs of a substantially corresponding size and shape, said first piece and a second set of circumferentially spaced punched out projecting tabs of substantially corresponding size and shape in said second piece that projects away from a first face of said first pieces and said second pieces when said second die is moved into said first die, and said front and rear tapered sections directing said tabs radially outwardly at a slight taper angle, said rounded portion directing said tabs radially outwardly at an acute taper angle, and said rear crimp portion directing said tabs at a transverse angle to a substantially flattened position against one another and against a face of one of said pieces to form a rivet head to secure said pieces together when the relative positions of said pieces and dies are reversed and said second die is moved against said tabs, and a two-way hydraulic cylinder mounted on the second arm, said cylinder having a housing with an actuating rod reciprocally movable in said housing for moving said second die, said hydraulic cylinder having means for automatically moving said actuating rod to the retracted position when hydraulic fluid pressure is removed there from.

* * * * *